US005333327A

United States Patent [19]

Redding et al.

[11] Patent Number: 5,333,327

[45] Date of Patent: Aug. 2, 1994

[54] APPARATUS FOR OPENING AND CLOSING A DRAIN

[75] Inventors: John C. Redding, Oostburg; Douglas J. Brouwer, Sheboygan, both of Wis.

[73] Assignee: Kohler Co., Kohler, Wis.

[21] Appl. No.: 18,651

[22] Filed: Feb. 17, 1993

[51] Int. Cl.[5] ..... E03C 1/23

[52] U.S. Cl. ..... 4/693; 4/679; 4/680; 4/684; 74/502.3; 74/501.6; 74/502

[58] Field of Search ..... 4/689, 690, 692, 693, 4/694, 684, 682, 691; 251/294; 74/502.3, 502, 501.6; 200/331

[56] References Cited

U.S. PATENT DOCUMENTS

| | | | |
|---|---|---|---|
| 1,035,849 | 8/1912 | Bergens . | |
| 1,544,088 | 6/1925 | Durey . | |
| 1,939,766 | 12/1933 | Corset | 74/502.3 |
| 1,974,419 | 9/1934 | Cornell, Jr. | 4/688 |
| 1,984,950 | 12/1934 | Steen | 4/203 |
| 2,063,399 | 12/1936 | Rasmussen | 4/694 |
| 2,313,554 | 3/1943 | Jones | 74/504 |
| 3,080,570 | 3/1963 | Weddendorf, Jr. | 4/689 |
| 3,099,019 | 7/1963 | Tiller | 4/200 |
| 4,188,835 | 2/1980 | Ion | 74/502.3 |
| 4,596,057 | 6/1986 | Ohta | 4/203 |
| 5,222,487 | 6/1993 | Carr et al. | 128/207.14 |

FOREIGN PATENT DOCUMENTS

| | | | |
|---|---|---|---|
| 0147648 | 7/1985 | European Pat. Off. | 74/502.3 |

*Primary Examiner*—Henry J. Recla
*Assistant Examiner*—Gregory Vidovich
*Attorney, Agent, or Firm*—Quarles & Brady

[57] ABSTRACT

Disclosed herein is a mechanism for remotely opening and closing a drain of a basin by means of a flexible rod moving through a non-linear tube. The rod connects a drive member, pushed or pulled by a user, with a member linked to a plug which opens and closes the drain. Within the bend of the tube, the flexible rod and/or tube are configured to leave a void between them in order to reduce friction. The configuration of the rod may include one or more bulbous ends or a lobed cross-section.

10 Claims, 3 Drawing Sheets

FIG. 1
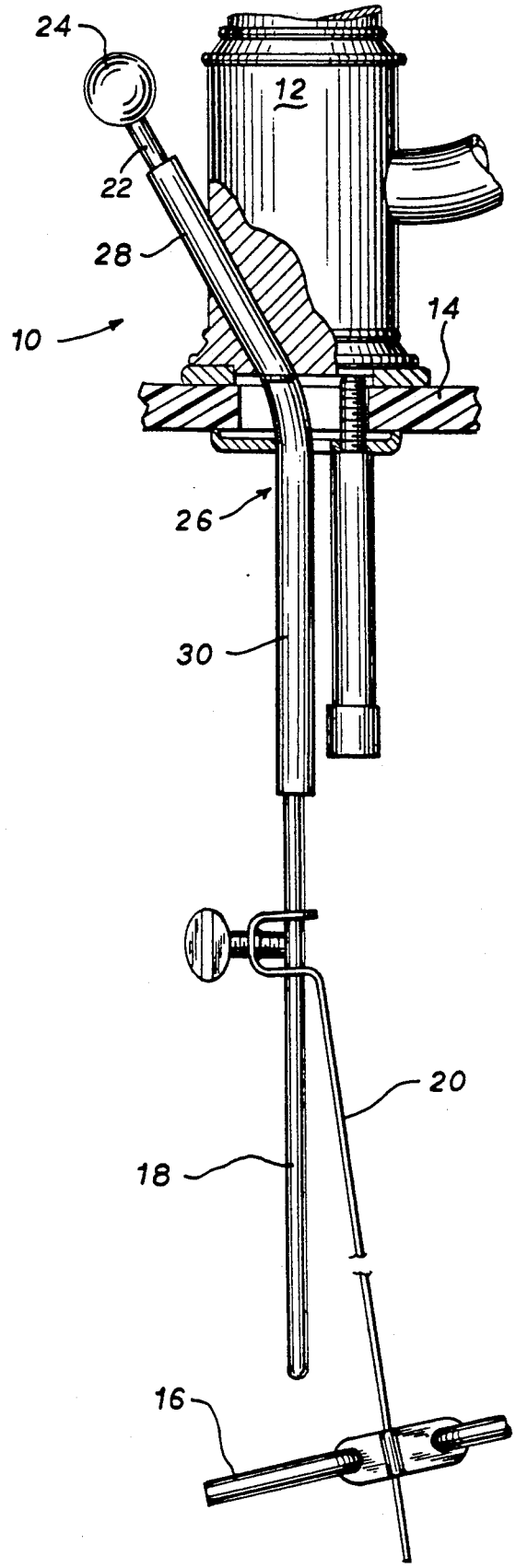
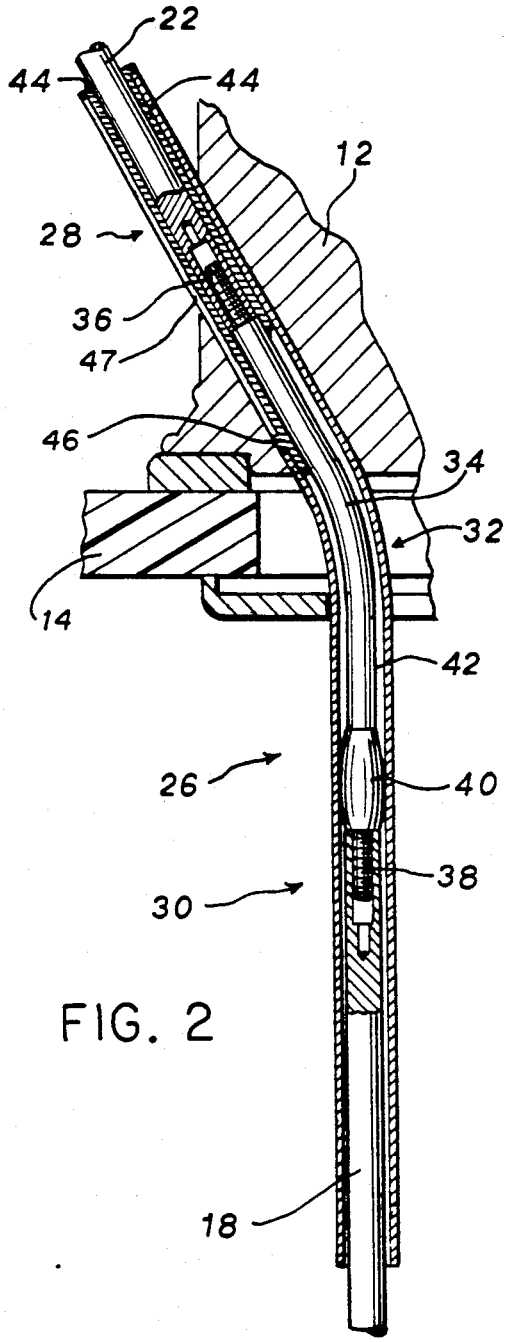
FIG. 2

APPARATUS FOR OPENING AND CLOSING A DRAIN

BACKGROUND OF THE INVENTION

1. Field of the Invention

The invention relates to mechanisms for remotely opening and closing the drain of a basin, such as a sink, lavatory or bathtub.

2. Description of the Art

Faucets are commonly provided with straight vertical rods which link a pull-up knob with a linkage member connected to the drain plug at the bottom of the sink or tub. If the rod is adjacent the faucet, it uses space in the faucet mounting hole, the size of which is often limited. If the vertical rod passes through the faucet itself, it complicates faucet design. Tilting a straight rod off the vertical may offer some relief from these problems, but introduces other problems, including making it more difficult to design an effective linkage member which will be able to produce the desired motion of the drain plug.

The deficiencies of the straight rod have prompted the use of flexible rods which can follow a non-linear path between the pull-up knob and the drain linkage member. Examples of this approach include U.S. Pat. Nos. 1,544,088, 1,974,419, 1,984,950, 3,099,019, and 4,596,057. Prior art systems often employ flexible cables which move through a tube which defines a non-linear path between the handle and the drain linkage member. In these devices, the flexible cable is in slidable contact with much of the inner surface of the tube. The resulting friction must be overcome by the user and may cause binding, particularly at the bend of the tube. These mechanisms tend to provide the user with a "feel" which is less smooth and "light" than the "feel" provided by the linear rod mechanisms.

Accordingly, there is a need for a remote drain operating mechanism that can follow a non-linear path but still provide the smoother and lighter feel and operation which can be provided by linear rods.

SUMMARY OF THE INVENTION

The invention provides an improved apparatus for remotely opening and closing a drain by mechanically transmitting motion from a drive member operated by the user (or an automated system) to a linkage member connected to the drain plug. The drive member and the drain linkage member extend into the ends of a passageway which has a bend in it. A flexible rod is positioned in the passageway and links the drive member with the drain linkage member. In a region positioned in the bend, the rod has a smaller cross-section than in a region positioned in the passageway between the narrower region and the drain linkage member. Accordingly, an enlarged void (passageway space not occupied by the flexible rod) is formed in the passageway at the bend.

In a preferred forth, the invention provides an improved apparatus for opening and closing a drain. It does so by mechanically transmitting motion from a drive member positioned adjacent one end of a passageway to a drain linkage member positioned adjacent another end of the passageway. The apparatus is of the type wherein the passageway has a bend in it. The improvement comprises a flexible rod positioned in the passageway and linked at one end to the drive member and at another end to the drain linkage member. The rod has a first region which is positioned proximate to the bend and a second region having a larger cross-sectional area than the first that is positioned in the passageway between the first region and the drain linkage member. An enlarged void is thereby formed between the rod and the passageway at the bend.

In another aspect, the invention provides a protective sleeve in the passageway into which a portion of the drive member extends. The sleeve may be made of a relatively non-abrasive material to protect the finish of the drive member, which may be visible to users. The sleeve also guides the flexible rod within the passageway and may be truncated to facilitate that function and reduce friction.

In another aspect, the invention provides an imposed apparatus for opening and closing a drain. It does so by mechanically transmitting motion from a drive member positioned adjacent one end of a passageway to a drain linkage member positioned adjacent another end of the passageway. The apparatus is of the type wherein the passageway has a bend in it. The improvement comprises a flexible rod positioned in the passageway and linked at one end to the drive member and at another end to the drain linkage member. The rod and an interior surface of the passageway are configured so as to create an enlarged void between them at the bend.

In yet another aspect, the invention provides an improved apparatus for opening and closing a drain, does so by mechanically transmitting motion from a drive member positioned adjacent one end of a passageway to a drain linkage member positioned adjacent another end of the passageway. The apparatus is of the type wherein the passageway has a bend in it. The improvement comprises a flexible rod positioned in the passageway and linked at one end to the drive member and at another end to the drain linkage member. The rod is transverse cross-sectionally configured so as to create on it a first longitudinal surface portion which slidably abuts a first longitudinal portion of the passageway and a second longitudinal surface portion which is spaced apart from a second longitudinal portion of the passageway.

It is an object of the invention to provide a remote drain operating mechanism which can follow a non-linear passageway and yet provide a smooth, light and high quality feel in the hands of the user.

It is a further object to minimize abrasion on any part of the mechanism which is visible to a user.

It is yet another object to create a pull-up apparatus of the above kind that is inexpensive to produce, easy to install and suitable to be part of a valve body.

These and other objects and advantages of the invention will be apparent from the description which follows. The preferred embodiments will be described in reference to the accompanying drawings. These embodiments do not represent the full scope of the invention. Rather, the invention may be employed in other embodiments. Reference should therefore be made to the claims herein for interpreting the breadth of the invention.

BRIEF DESCRIPTION OF THE DRAWINGS

FIG. 1 is a side elevational view, partially broken away, of an embodiment of the invention;

FIG. 2 is a side cross-sectional view the embodiment of FIG. 1;

DESCRIPTION OF THE PREFERRED EMBODIMENTS

Figure 5:
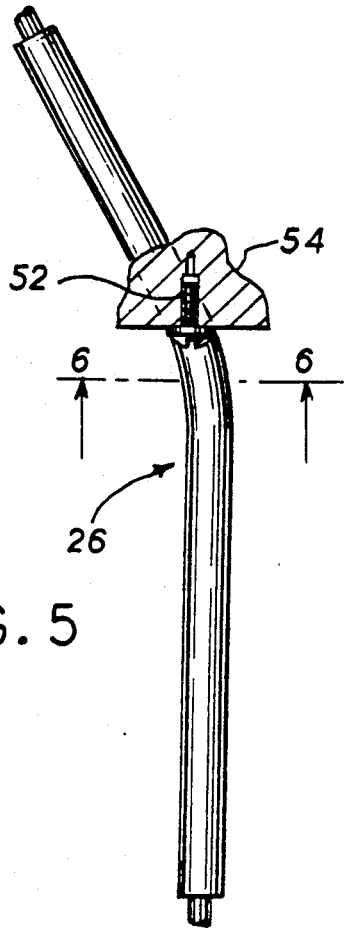
FIG. 5 is a side elevational view of a tube for housing the flexible rod and an associated mounting system.

FIG. 1 shows a remote drain operating apparatus 10 included as part of a faucet 12 mounted on a sink 14. Sink 14 has the usual drain hole (not shown) which is opened and closed by a conventional drain plug (not shown) which is raised and lowered by lever-end 16. Downward movement of lever-end 16 raises the drain plug and opens the drain. Upward movement of lever-end 16 lowers the drain plug and closes the drain. Lever-end 16 is connected to a vertical drain linkage member 18 by conventional connecting rod 20.

Still referring to FIG. 1, a drive member 22 supports a pull-up knob 24 at one end, and its other end extends into a cylindrical tube 26 which has an upper, linear, non-vertical portion 28 which transitions downward to a lower, linear, vertical portion 30 via bend 32. Tube 26 therefore defines a non-linear passageway.

As shown in FIG. 2, drive member 22 is linked via tube 26 to drain-linkage member 18, whose upper end extends into the bottom of the vertical portion 30 of tube 32.

Figure 4:
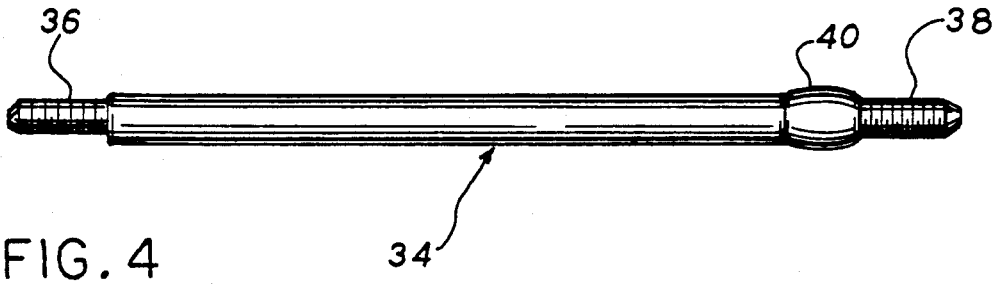
FIG. 4 is a side elevational view of a flexible rod of the present invention.

Flexible rod 34, which is shown enlarged in FIG. 4, is an elongated cylinder having male threaded ends 36, 38. Adjacent one threaded end 38, flexible rod 34 enlarges into a convex, bulbous portion 40 which, at its widest circumference, is in slidable contact with the interior of tube 26. The cross-sectional area of the balance of flexible rod 34 is smaller than the interior cross-section of tube 26, thereby producing an enlarged void 42 of space within tube 26 (including bend 32) which is not occupied by flexible rod 34. Flexible rod 34 may be made by injection 25 molding from a flexible but tough nylon with high abrasion resistance, such as nylon 1,000L.

Figure 3:
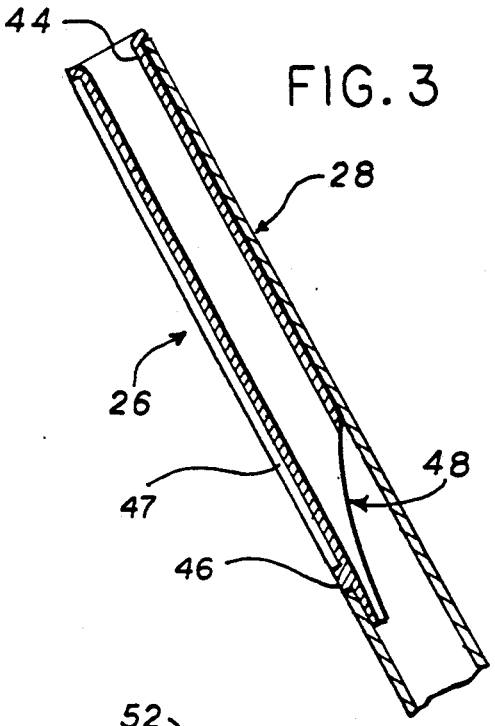
FIG. 3 is an enlarged side cross-sectional view focusing on a sleeve.

As shown in FIG. 2, threaded ends 36 and 38 of flexible rod 34 are threadably connected within tube 26 to the inward ends of drive member 22 and drain linkage member 18 respectively. A sleeve 44 (best shown in enlarged cross-section in FIG. 3) may be used in the apparatus 10. Sleeve 44 is a hollow cylindrical tube which has an external guide peg 46 and a truncated inward end 48. Sleeve 44 may be made by injection molding from an acetal copolymer having high lubricity, such as celcon M90. Sleeve 44 is inserted into the upper end of the non-vertical portion 28 of tube 26. It is oriented by means of engaging guide peg 46 with a corresponding slot 47 in the interior of tube 26, so that the longer portion of truncated end 48 is immediately adjacent to the inside curve of bend 32. As shown in FIG. 3, the slot preferably runs on a bottom wall of tube 26 from the inlet to at least the position of the peg 46. The longer portion of truncated end 48 serves as a smooth sliding surface for the drive member 22 and for the rod 34 as it approaches the inside curve of bend 32, so as to minimize abrasive scars on the drive member 22, while the shorter portion of truncated end 48 avoids unnecessary friction on the rod 34. The sleeve 44 also contributes to a smooth and light "feel" which is desirable in a high quality fitting. Drive member 22 extends into sleeve 44 from the top, and threaded end 36 of rod 34 extends into it from the bottom.

Figure 6:
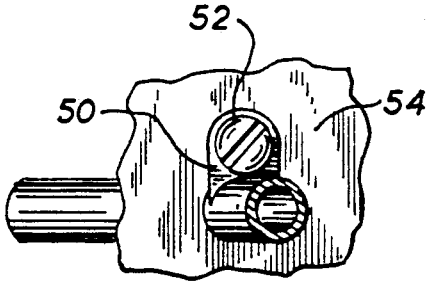
FIG. 6 is an enlarged view taken along line 6—6 of FIG. 5.

FIGS. 5 and 6 show tube 26 in greater detail. A mounting bracket 50 projects transversely from it. A screw 52 may be employed to attach tube 26 to a structural part 54 of faucet 12. Tube 26 is typically made of brass and is finished to present an attractive appearance at its upper, visible end.

In operation, a user pulls on pull-up knob 24 to close the drain. This action is transmitted to flexible rod 34 via drive member 22. Flexible member 34 pulls drive linkage member 18 upward which, by means of connecting rod 20, raises lever 16 and thereby lowers the drain plug into the drain. During this action, flexible rod 34 tends to straighten so that a portion of its surface 56 adjacent the inside curve of the bend slides along the interior of tube 26 at the bend. However, the contact is minimized due to the void.

Another point of friction contact is between the widest part of bulbous portion 40 and the interior of tube 26. A final point of contact is between end 36 of flexible rod 34 the truncated end 48 of sleeve 44. However, the balance of the length of flexible rod 34 is separated from or only lightly touch the interior of tube 26.

The reverse happens when the user pushes on knob 24 in order to open the drain plug, except that at the bend 32 the slidable contact between flexible rod 34 and tube 26 is at the outside curve of bend 32.

As a result, over much of the length of flexible rod 34 there is little or no contact between rod 34 and tube 26. There is also no metal-on-metal contact as the rod is plastic. Thus overall friction is less, and the finish of drive member 22 is preserved from abrasive scars by sleeve 44.

Figure 7:
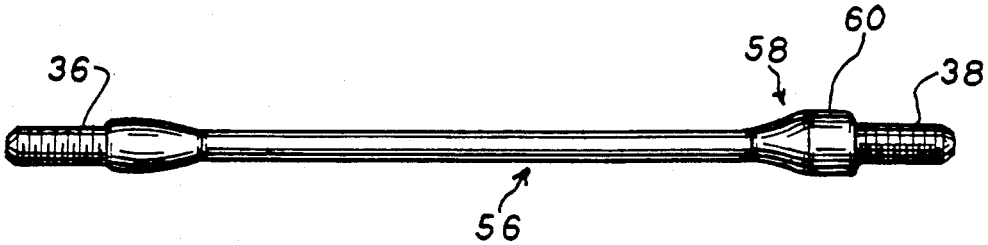
FIG. 7 is a second embodiment of the flexible rod.
Figure 8:
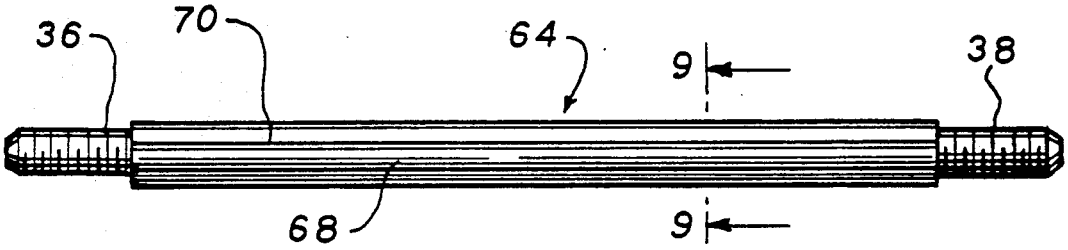
FIG. 8 is a third embodiment of the flexible rod.
Figure 9:
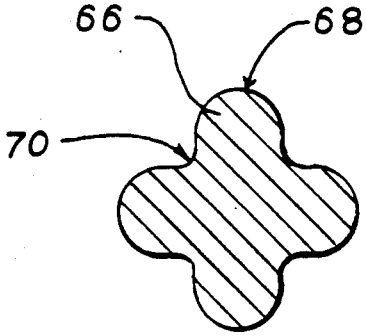
FIG. 9 is an enlarged cross-sectional view taken on line 9—9 of FIG. 8.

FIGS. 7 through 9 show alternate embodiments of flexible rod 34 which may be used in tube 26.

FIG. 7 shows a thinner flexible rod 56 which at its end 38 has a bulbous portion 58 which culminates in a cylindrical portion 60, rather than being generally convex as in bulbous portion 40 of rod 34. In addition, flexible rod 56 has a correspondingly shaped, but smaller (so as to slide within sleeve 44), bulbous portion 62 adjacent its other end 36.

FIGS. 8 and 9 show a flexible rod 64 which lack bulbous ends but has a wider and lobed cross-sectional shape 66. The peaks 68 of the lobes are designed to be in slidable contact with the interior of tube 26. The valleys 70 between peaks 68 are spaced apart from the interior of tube 26 in order to reduce friction. Other cross-sectional shapes which provide a sliding portion and a spaced apart portion may be used as well.

From the foregoing, it will be appreciated that the invention provides a remotely activated drain operating mechanism that operates along a non-linear path and yet permits an operation and feel which is as smooth and light as that of a straight line rod mechanism. In addition, the visible part of drive member 22 is protected from abrasive surface damage. Accordingly, the mechanism is suitable for use in a very high quality and attractive plumbing fixture.

Although the especially preferred embodiments of the invention have been described above, the invention claimed is not so restricted. There may be various other modifications and changes to these embodiments which are within the scope of the invention. For example, tube 26 might be widened in the area of bend 32 in order to reduce friction at the bend. Thus, the invention is not to be limited by the specific description above, but should be judged by the claims which follow.

We claim:

1. In an apparatus for opening and closing a drain that does so by mechanically transmitting motion from a drive member positioned adjacent one end of a passageway to a drain linkage member positioned adjacent another end of the passageway, of the type wherein the passageway has a bend in it, the improvement comprising:

a flexible rod positioned in the passageway and linked at one end to the drive member and at another end to the drain linkage member, the rod having a first region which is positioned proximate to the bend and a second region having a larger cross-sectional area than the first region that is positioned in the passageway between the first region and the drain linkage member, whereby an enlarged void is formed between the rod and the passageway at the bend; and a protective sleeve positioned in the passageway between the drive member end and the bend and extending to a point adjacent to the bend, a portion of the drive member extending into the sleeve wherein the sleeve has an end portion adjacent the bend and the end portion is obliquely configured such that the sleeve has a longer portion which is adjacent to an inside curve of the bend.

2. The apparatus of claim 1, wherein the rod has a third region positioned in the passageway proximate the drain linkage member end, the third region comprising a bulbous portion.

3. The apparatus of claim 1, wherein the sleeve is lubricious.

4. In an apparatus for opening and closing a drain that does so by mechanically transmitting motion from a drive member positioned adjacent one end of a passageway to a drain linkage member positioned adjacent another end of the passageway, of the type wherein the passageway has a bend in it, the improvement comprising:

a flexible rod positioned in the passageway and linked at one end to the drive member and at another end to the drain linkage member, the rod and an interior surface of the passageway being configured so as to create an enlarged void between them at the bend; and a protective sleeve positioned in the passageway between the drive member end and the bend and extending to a point adjacent the bend, a portion of the drive member extending into the sleeve wherein the sleeve has an end portion adjacent the bend and the end portion is obliquely configured such that the sleeve has a longer portion which is adjacent to an inside curve of the bend.

5. The apparatus of claim 4, wherein the sleeve is lubricious.

6. In an improved apparatus for opening and closing a drain that does so by mechanically transmitting motion from a drive member positioned adjacent one end of a passageway to a drain linkage member positioned adjacent another end of the passageway, of the type wherein the passageway has a bend in it, the improvement comprising:

a flexible rod positioned in the passageway and linked at one end to the drive member and at another end to the drain linkage member, the rod being transverse cross-sectionally configured so as to create on it a first longitudinal surface portion which slidably abuts a first longitudinal portion of the passageway and a second longitudinal surface portion which is spaced apart from a second longitudinal portion of the passageway; and a protective sleeve positioned in the passageway between the drive member end and the bend and extending to a point adjacent the bend, a portion of the drive member extending into the sleeve wherein the sleeve has an end portion adjacent the bend and the end portion is obliquely configured such that the sleeve has a longer portion which is adjacent to an inside curve of the bend.

7. The apparatus of claim 6 in which the transverse cross-sectional configuration of the rod includes at least two lobes.

8. The apparatus of claim 6, wherein the sleeve is lubricious.

9. In an apparatus for opening and closing a drain that does so by mechanically transmitting motion from a drive member positioned adjacent one end of a passageway to a drain linkage member positioned adjacent another end of the passageway, of the type wherein the passageway has a bend in it, the improvement comprising:

a flexible rod positioned in the passageway and linked at one end to the drive member and at another end to the drain linkage member, the rod having a first region which is positioned proximate to the bend and a second region having a larger cross-sectional area than the first region that is positioned in the passageway between the first region and the drain linkage member, whereby an enlarged void is formed between the rod and the passageway at the bend; and a protective sleeve positioned in the passageway adjacent the drive member end, a portion of the drive member extending into the sleeve, wherein the sleeve has an essentially diagonally truncated end adjacent the bend, the truncation being such that a longer portion of the end is adjacent to an inside curve of the bend.

10. The apparatus of claim 9, wherein the sleeve is lubricious.

* * * * *